US005492232A

United States Patent [19]

Ohm

[11] Patent Number: 5,492,232

[45] Date of Patent: Feb. 20, 1996

[54] UMBRELLA-SHAPED CLOTHES-DRYING RACK

[75] Inventor: Heinz J. Ohm, Linburg, Germany

[73] Assignee: Leifheit AG, Nassau/Lahn, Germany

[21] Appl. No.: 306,157

[22] Filed: Sep. 14, 1994

[30] Foreign Application Priority Data

Sep. 15, 1993 [EP] European Pat. Off. ..... 93114798

[51] Int. Cl.[6] ..... A47B 43/00

[52] U.S. Cl. ..... 211/197; 135/20.3

[58] Field of Search ..... 135/20.3, 19.5, 135/20.1, 28, 38, 41; 211/197

[56] References Cited

U.S. PATENT DOCUMENTS

| | | | |
|---|---|---|---|
| 2,289,450 | 7/1942 | Pollard et al. . | |
| 2,661,752 | 12/1953 | Kampf et al. | 135/20.3 |
| 4,735,322 | 4/1988 | Steiner | 211/119.01 |

FOREIGN PATENT DOCUMENTS

| | | | |
|---|---|---|---|
| 277284 | 8/1965 | Australia | 211/197 |
| 229252 | 9/1963 | Austria | 211/197 |
| 0113789 | 9/1986 | European Pat. Off. . | |
| 0220565 | 5/1987 | European Pat. Off. . | |
| 2681224 | 3/1993 | France | 135/19.5 |
| 633855 | 2/1962 | Italy | 211/197 |
| 388240 | 2/1965 | Switzerland | 211/197 |

*Primary Examiner*—Leslie A. Braun
*Assistant Examiner*—Willie Berry, Jr.
*Attorney, Agent, or Firm*—Frishauf, Holtz, Goodman, Langer & Chick

[57] ABSTRACT

An umbrella-shaped clothes-drying rack has a pole 1, on which main arms 4 which are arranged to hold a clothes line are pivotably mounted via a star-shaped slider 2. Spreading arms 6 are provided between the main arms 4 and the pole 1. One end of each spreading arm 6 is pivotably mounted on a fixed holding member 3 which is fastened to the pole 1, and the other end of each spreading arm 6 is pivotably attached to a respective main arm 4. To ease the spreading of the umbrella-shaped clothes-drying rack in the beginning phase of opening, a spreading body 9 is slidably disposed in the upper portion of the pole 1 and cooperates with cam members 13 on the spreading arms 6 and displaces the spreading arms 6 by means of pulling on a pull rope 15 far enough so that the main arms 4 can be further unfolded to a fully open position without a great exertion of force by manually pushing the slider 2 up and/or by manually pulling downwardly and outwardly on the main arms 4.

20 Claims, 3 Drawing Sheets

UMBRELLA-SHAPED CLOTHES-DRYING RACK

FIELD OF THE INVENTION

This invention relates to an umbrella-shaped clothes-drying device or rack with a vertical pole wherein radial arms supporting the clothes line are pivotably mounted on a slider which is mounted on the pole and are further supported by means of spreading arms.

BACKGROUND OF THE INVENTION

With known umbrella-shaped clothes-drying racks of the type to which the present invention pertains (for example, see U.S. Pat. No. 2,289,450, the entire contents of which are incorporated herein by reference), opening the umbrella-shaped clothes-drying rack at the initial stages of opening requires a comparatively large expenditure of force until the radial arms have reached a certain angular position relative to the vertical support pole. It has already been attempted to overcome this disadvantage by employing a pulling line which is guided in the manner of a block and pulley. But, even such a pulley-type pulling line device can only ease the spreading of the arms of the umbrella-shaped clothes-drying rack after the arms have been pivoted out of their vertical rest position by a certain angle, which has to be done manually.

A considerable improvement has been achieved in the umbrella-shaped clothes-drying rack in accordance with European Patent Disclosure EP 0 113 789-B1 (the entire contents of which are incorporated hereby by reference), wherein, with the umbrella-shaped clothes-drying rack folded up, the hinge axes of the spreading arms are located outside of an imaginary connecting line between the pivot axes of the arms and the holding shafts of the spreading arms. When pulling on the pulling line, this arrangement always results in a sufficient force component oriented away from the vertical support pole for pivoting the arms out of their respective vertical rest positions. Therefore, the initial spreading of the arms by hand is no longer required. However, it is not possible to displace the hinge or pivot shafts of the spreading arms too far toward the outside, because otherwise the arms come to rest at a relatively great transverse distance from the pole in the folded state, which would increase the space requirements of the folded umbrella-shaped clothes-drying rack.

SUMMARY OF THE INVENTION

It is the object of the present invention to provide an improved umbrella-shaped clothes-drying rack or device, wherein the spreading of the arms thereof can be performed with a very small expenditure of force by means of a simply guided pull rope, and wherein in the folded state, the arms come to rest at a very short distance from the vertical support pole, so that the space requirements of the umbrella-shaped clothes-drying rack during storage as well as transport are kept as small as possible.

According to the present invention, an umbrella-shaped clothes-drying rack comprises a vertical pole having an internal space; a slider member slidably mounted on the pole so as to be slidable along the pole in a longitudinal direction of the pole; a plurality of main arms for supporting a clothes line, the main arms being pivotably mounted on the slider member; a plurality of spreading arms, each spreading arm having one end which is pivotally mounted to the pole at a position above the slider member, and each spreading arm having another end which is pivotably mounted to a respective main arm; a spreading body longitudinally displaceably mounted on the pole and having an operating portion arranged below the pivotal connections of the spreading arms to the pole; and cam members disposed on the spreading arms and cooperating with a cam surface of the operating portion of the spreading body during longitudinal displacement of the spreading body relative to the pole, such that the spreading body causes the spreading arms to pivot out of respective folded rest positions, where the spreading arms are substantially adjacent to the pole, toward an open position where the spreading arms are spaced from the pole.

Further features of the invention will be apparent from the following description taken in connection with the drawings, which illustrate an exemplary embodiment of the invention.

DETAILED DESCRIPTION

A star-shaped slider 2, having projecting ears 32, is displaceably mounted on a hollow vertical support pole 1 so as to be slidable along the longitudinal direction of the pole 1. A star-shaped holding member 3 is fixedly mounted on the upper portion of the pole 1. The slider 2 and the holding member 3 need not be star shaped. They could have any peripheral shape, but they will be referred to herein as star-shaped for clarity of description.

Figure 1:
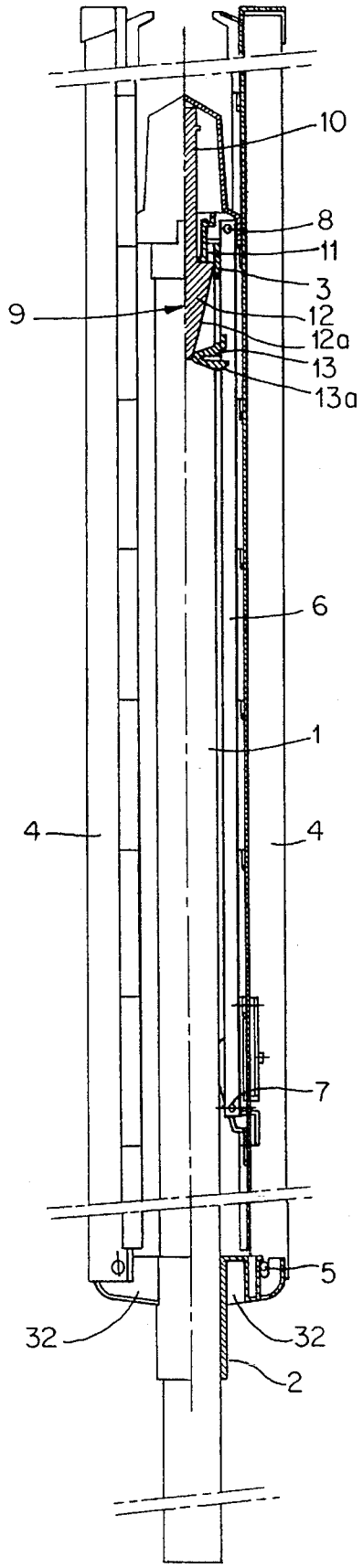
FIG. 1 shows a umbrella-shaped clothes-drying rack or device in the folded state, the portion on the right half of the center line being represented in longitudinal cross section.
Figure 2:
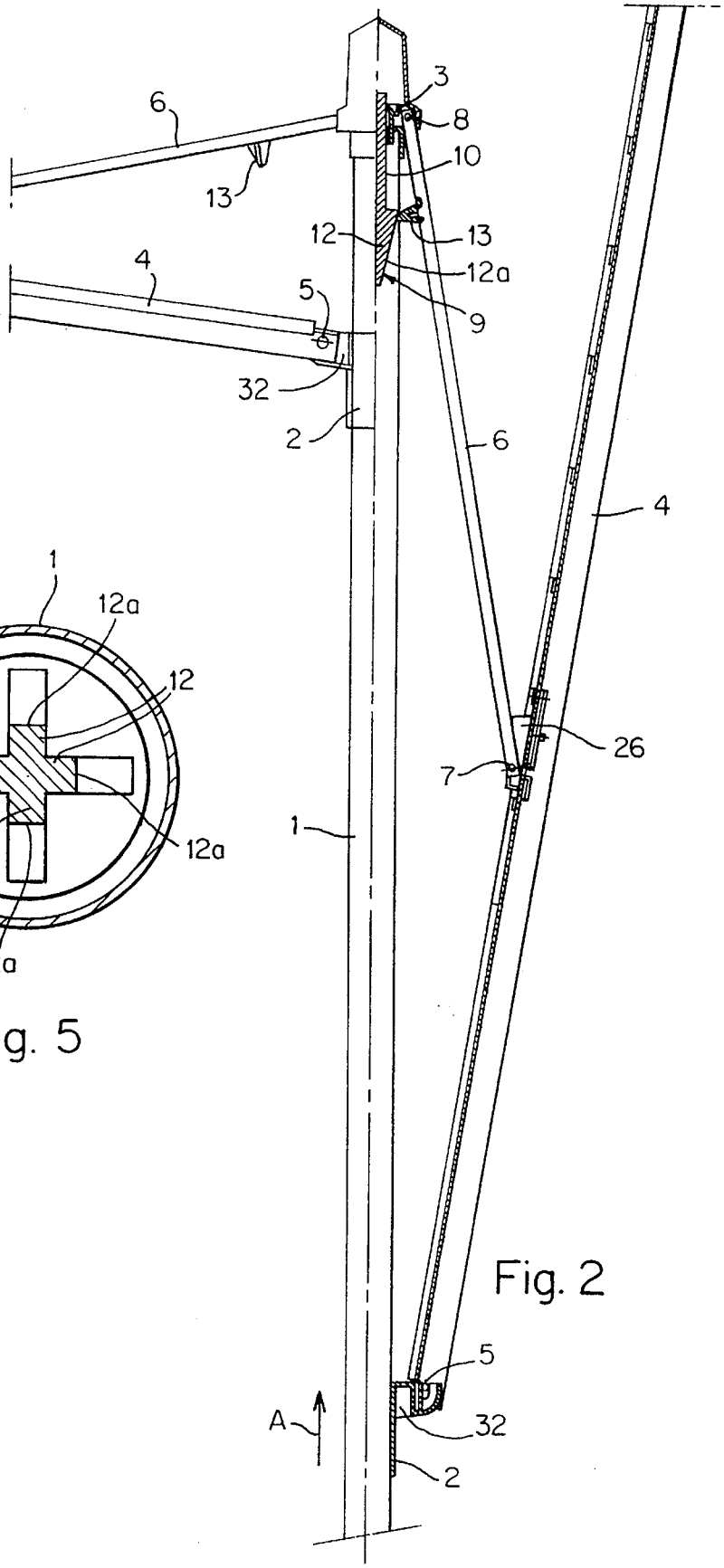
FIG. 2 shows, in the right half thereof, the umbrella-shaped clothes-drying rack of FIG. 1 in longitudinal section shortly after the start of the spreading process, the left half of FIG. 2 showing the arms in the fully spread state.

Four main arms 4 are respectively pivotably mounted on the projecting ears 32 of the star-shaped slider 2 by means of pivot or hinge shafts 5. A clothes line, not shown, is stretched between the main arms 4, for example as shown in U.S. Pat. No. 2,289,450. The main arms 4 are supported on the star-shaped holding member 3 by means of spreading or intermediate arms 6. The spreading arms 6 are pivotally mounted at one end by pivot or hinge shafts 7 to the respective main arms 4 (see FIGS. 1 and 2). The spreading arms 6 are connected at their other ends to respective fixed position pivot shafts 8 on the fixed-position star-shaped holding member 3 (see FIGS. 1 and 2). As can be seen in FIG. 2, the main arms 4 are spread outwardly by an upward displacement of the star-shaped slider 2 (in the direction of arrow A) relative to the pole 1, and the umbrella-shaped clothes-drying rack is thereby opened for use.

Figure 5:
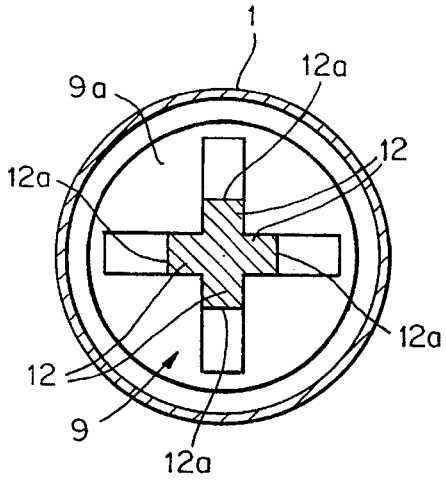
FIG. 5 is a cross section taken along the line 5—5 of FIG. 3, on an enlarged scale.
Figure 3:
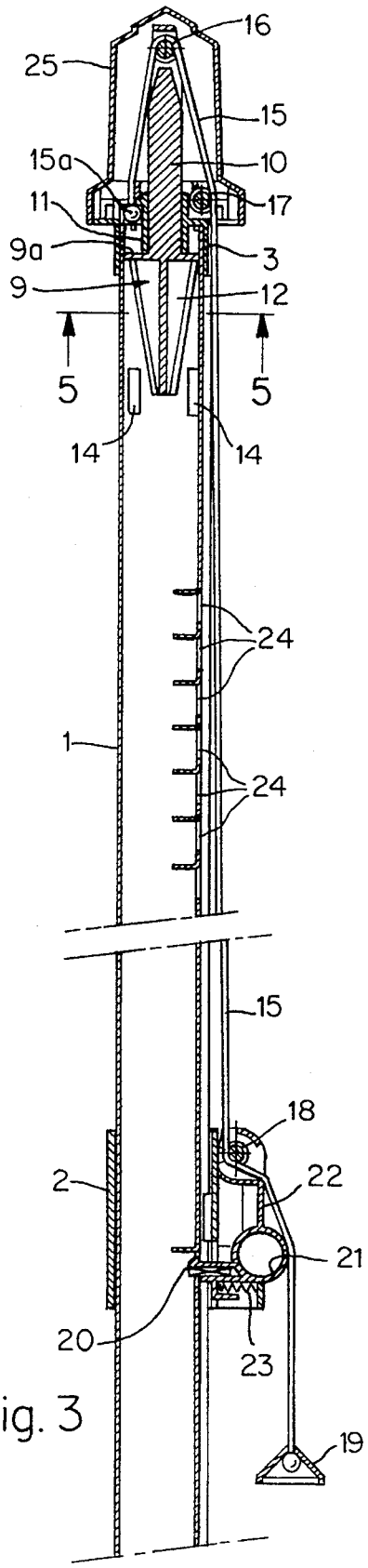
FIG. 3 is a longitudinal section of the umbrella-shaped clothes-drying rack on an enlarged scale and turned by 90° with respect to the view in FIG. 1.
Figure 4:
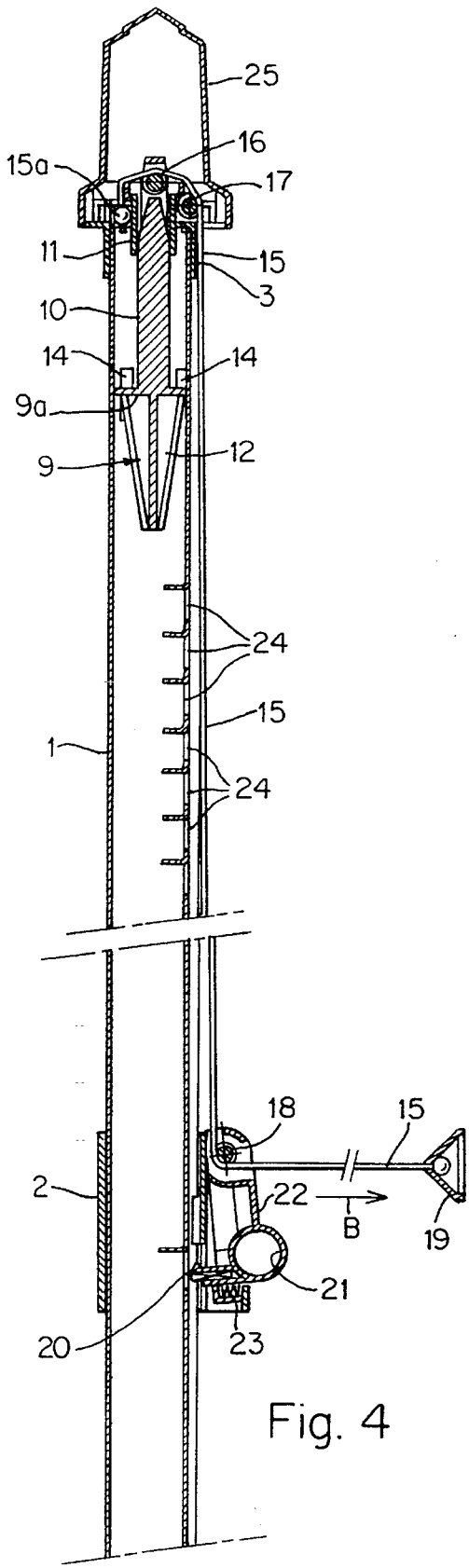
FIG. 4 is a longitudinal section of the umbrella-shaped clothes-drying rack on an enlarged scale and turned by 90° with respect to the view in FIG. 2.

To ease spreading of the arms of the umbrella-shaped clothes-drying device in the beginning phases of opening, a spreading body 9 is disposed in an elongated hollow space in the upper end section of the hollow pole 1 with operating portions thereof being arranged below the fixed-position star-shaped holding member 3. The spreading body 9 is displaceable in the longitudinal direction of the pole 1 and is guided by an elongated projection 10, mounted on the upper end of the pole 1, in a bushing 11 of the star-shaped holding member 3. In the illustrated embodiment, the spreading body 9 has four operating portions in the form of four cams or ribs 12 (see FIG. 5), one for each spreading arm 6, which cams or ribs 12 are widened (see FIGS. 3 and 4) in the direction from the lower end of the spreading body 9 toward the upper end of the spreading body 9. The cams or ribs 12 are formed by a plate 9*a*, so that their longitudinal edges 12a are located on the generating surface of a slight cone.

A spreading arm 6 cooperates with each respective cam or rib 12 via a cam member (follower) 13, which is mounted on the respective spreading arms 6 and which is located at a given distance from the holding pivot shaft 8. The cam members (followers) 13 are mounted in an opening 13*a* in the wall of the respective spreading arm 6 (see FIG. 1). In the folded state of the umbrella-shaped clothes-drying rack (FIG. 1), the cam members 13 project through a respective recess 14 (see FIGS. 2 and 3) in the wall of the pole 1 and rest against the longitudinal edge 12*a* of the respective cam or rib 12, as shown in FIG. 1. As can be seen from FIG. 5, the longitudinal edges 12*a* of the respective cams or ribs 12 are generally straight in order to prevent lateral sliding of the cam members 13 when the spreading body 9 is moved downward.

A pull rope 15 (see FIGS. 3 and 4) is provided for downwardly displacing the spreading body 9 and is fastened at one end 15*a* on the star-shaped holding member 3. The pull rope 15 extends over a first roller 16, over a second roller 17 on the star-shaped holding member 3 and over a third roller 18 on the star-shaped slider 2. The pull rope 15 is provided with a handle 19 at its free end. By pulling on the free end of the pull rope 15 in the direction of arrow B in FIG. 4, the spreading body 9 is moved downward out of its rest position shown in FIGS. 1 and 3. The spreading body rests at its rest position with its horizontal plate or stop member 9*a* on the lower end of the bushing 11 (see FIG. 4). As a result of the downward movement of the spreading body 9, out of its rest position, the spreading arms 6 are pivoted outward via the cam members (followers) 13 bearing on the camming surface of respective cams 12. This is shown in the right half of FIG. 2.

To prevent the displacement of the star-shaped slider 2 from its rest position, an arresting (locking) or stop device in the shape of a hook or latch 20 (FIGS. 3 and 4) is provided on the star-shaped slider 2. The hook or latch 20 is mounted in a pivotable member 22 which is provided with a grasping handle or pull ring 21. The pivotable member 22 is mounted so as to be pivotable around the axis of the roller 18, on the star-shaped slider 2 and is biased by means of a spring 23 into the locked position shown in FIG. 3, wherein the hook or latch pin 20 projects through a hole or recess in the wall of the pole 1 to lock the slider 2 relative to the pole 1. For spreading the umbrella-shaped clothes-drying rack, the hook or latch pin 20 is pulled out of the hole or recess in the pole 1 (by means of the handle or pull ring 21) against the bias force of the spring 23 (see position shown in FIG. 4), and now the star-shaped slider 2 can be moved upward by pulling outwardly on the pull rope 15 (in the direction of arrow B in FIG. 4) and/or by direct pushing upwardly by hand, and the main arms 4 ultimately achieve the fully extended position shown in the left half of FIG. 2. The star-shaped slider 2 can be arrested or stopped (locked) in this fully raised position shown in FIG. 2 by the engagement of the hook or latch pin 20 in another one of the upper recesses 24 (FIGS. 3 and 4) in the wall of the pole 1.

A top protective cap 25 over the fixed-position, star-shaped holding member 3 covers the displacement mechanism of the spreading body 9 and the top of the pole 1 and protects against the effects of weather. The top cap 25 also prevents a user from contacting the internal mechanism, and provides a decorative outer appearance.

Because of the provision of the spreading body 9, the amount of force for initiating a spreading movement of the umbrella-shaped clothes-drying rack is very small, so that the entire spreading process can be easily accomplished, namely with one hand by pulling on the pull rope 15. If the user wishes to accelerate the spreading process by a manual downward pivoting of one main arm 4, the user can use handles 26 (FIG. 2) attached to the main arms 4 for this purpose. Also, the user can manually push the slider 2 upwardly to accelerate the spreading process.

Because the mechanism for causing the initial spreading, namely the spreading body 9, is disposed inside the vertical support pole 1, the main arms 4 and the spreading arms 6 come to rest substantially parallel with the pole 1 and at a very short distance from the pole 1 in the folded state (see FIG. 1). Thus, the space requirement of the umbrella-shaped clothes-drying rack is very small, which is important for storage as well as for transporting.

In accordance with the present invention, it is possible to exert a large spreading force on the spreading arms 6 with only a small expenditure of force by means of the spreading body 9 in order to bring the spreading arms 6 and the main arms 4 into an intermediate angular position from which they can be brought into the fully spread position requiring little force by pushing the star-shaped slider 2 up. In the folded-up position of the umbrella-shaped clothes-drying rack, the hinge or pivot shafts 7 of the spreading arms 6 may be located on a connecting line between the pivot axes 5 and the holding axes 3 or even between this connecting line and the pole, so that in the folded-up state, the arms 4,6 come to rest substantially parallel to the pole 1 at a very short distance from the pole, which results in the aforementioned extremely compact construction.

Various changes and modifications may be made within the scope of the inventive concept as claimed. For example, the operating direction of movement of spreading body (9) could be reversed, with suitable consequential changes being made to the camming surfaces and other structures to operate the spreading arms (6).

I claim:

1. An umbrella-shaped clothes-drying rack comprising:

a vertical pole (1) having an internal space;

a slider member (2) slidably mounted on said pole (1) so as to be slidable along said pole (1) in a longitudinal direction of said pole (1);

a plurality of main arms (4) for supporting a clothes line, said main arms (4) being pivotably mounted on said slider member (2);

a plurality of spreading arms (6), each spreading arm (6) having one end which is pivotably mounted to said pole (1) at a position above said slider member (2), and each spreading arm (6) having another end which is pivotably mounted to a respective main arm (4);

a spreading body (9) longitudinally displaceably mounted on said pole (1) and having an operating portion (12) arranged below the pivotal connections of said spreading arms (6) to said pole; and cam members (13) disposed on said spreading arms (6) and cooperating with a cam surface (12) of said operating portion (12) of said spreading body (9) during longitudinal displacement of said spreading body (9) relative to said pole (1), such that said spreading body (9) causes said spreading arms (6) to pivot out of respective folded rest positions, where said spreading arms (6) are substantially adjacent to said pole (1), toward an open position where said spreading arms (6) are pivoted away from and spaced from said pole (1).

2. The umbrella-shaped clothes-drying rack of claim 1, further comprising a pull rope (15) coupled to said spreading body (9) for displacing said spreading body (9) relative to said pole (1) to a position where said operating portion (12) of said spreading body (6) engages said cam members (13) and spreads the spreading arms (6).

3. The umbrella-shaped clothes-drying rack of claim 2, wherein:

said pull rope (15) has a first end (15*a*) which is fastened to the pole (1) and is guided over a first rope guide member (16) on said spreading body (9) and over a second rope guide member (18) on said slider member (2); and further comprising a releasable locking member (20) for releasably locking said slider member (2) relative to said pole (1) at a given folded or rest position of said main and spreading arms (4,6).

4. The umbrella-shaped clothes-drying rack of claim 3, wherein said first and second rope guide members (16,18) comprise first and second rollers, respectively.

5. The umbrella-shaped clothes-drying rack of claim 4, wherein said locking member comprises a latch (20) disposed on a pivotable member (22) having a handle (21), said pivotable member (22) being pivotably mounted on said slider member (2) so as to be pivotable around an axis of rotation of said second roller (18), and being biased toward a locking position, said pivotable member (22) being pivotable away from said pole (1) to a position where the locking of said slider member (2) is released.

6. The umbrella-shaped clothes-drying rack of claim 5, further comprising a holding member (3) fixedly mounted to said pole (1), and to which said one end of each of said spreading arms (6) is pivotably mounted, said holding member (3) being fixed to said pole (1) at an upper portion of said pole (1).

7. The umbrella-shaped clothes-drying rack of claim 6, wherein:

said first end (15*a*) of said pull rope (15) is fastened to said holding member (3); and said spreading body (9) has a longitudinal projection (10) slidably extending through an aperture of said holding member (3) and supporting said first rope guide member (16).

8. The umbrella-shaped clothes-drying rack of claim 3, further comprising a holding member (3) fixedly mounted to said pole (1), and to which said one end of each of said spreading arms (6) is pivotably mounted, said holding member (3) being fixed to said pole (1) at an upper portion of said pole (1).

9. The umbrella-shaped clothes-drying rack of claim 8, wherein:

said first end (15*a*) of said pull rope (15) is fastened to said holding member (3); and said spreading body (9) has a longitudinal projection (10) slidably extending through an aperture of said holding member (3) and supporting said first rope guide member (16).

10. The umbrella-shaped clothes-drying rack of claim 9, further comprising a stop member (11) against which said spreading body (9, 9*a*) rests in its rest position where the rack is folded.

11. The umbrella-shaped clothes-drying rack of claim 1, wherein said operating portion (12) of said spreading body (9) is cone-shaped.

12. The umbrella-shaped clothes-drying rack of claim 11, wherein said operating portion (12) of said spreading body (9) includes a plurality of ribs (12) corresponding in number to the number of said spreading arms (6), said ribs (12) having inclined cam surfaces located on a generating surface of a cone.

13. The umbrella-shaped clothes-drying rack of claim 1, wherein said cam members (13) are mounted in respective openings (13*a*) in said spreading arms (6) and extend in a folded rests position of said spreading arms (6) through respective recesses (14) in a wall of said pole (1).

14. The umbrella-shaped clothes-drying rack of claim 1, further comprising a stop member (11) against which said spreading body (9, 9*a*) rests in its rest position where the rack is fully folded.

15. The umbrella-shaped clothes-drying rack of claim 14, wherein said stop member comprises a bushing (11) in which said spreading body (9,10) is slidably mounted.

16. The umbrella-shaped clothes-drying rack of claim 14, further comprising a holding member (3) fixedly mounted to said pole (1), and to which said one end of each of said spreading arms (6) is pivotably mounted, said holding member (3) being fixed to said pole (1) at an upper portion of said pole (1); and wherein said stop member comprises a lower end of a bushing (11) on said holding member (3), which guides a projection (10) of said spreading body (9).

17. The umbrella-shaped clothes-drying rack of claim 14, further comprising a holding member (3) fixedly mounted to said pole (1), and to which said one end of each of said spreading arms (6) is pivotably mounted, said holding member (3) being fixed to said pole (1) at an upper portion of said pole (1); and wherein said stop member comprises a lower end of a bushing (11) on said holding member (3), which guides said projection (10) of said spreading body (9).

18. The umbrella-shaped clothes-drying rack of claim 1, wherein said slider member (2) comprises a star-shaped slider having projections on which said main arms (4) are respectively pivotably mounted.

19. The umbrella-shaped clothes-drying rack of claim 1, wherein said one end of each spreading arm (6) is pivotally mounted to said pole (1) by means of a holding member (3) which is fixedly mounted to an upper portion of said pole (1).

20. The umbrella-shaped clothes-drying rack of claim 19, wherein said holding member (3) comprises a star-shaped member having projections on which said one ends of said spreading arms (6) are respectively pivotably mounted.

* * * * *